US007422048B2

(12) United States Patent
Andersen

(10) Patent No.: US 7,422,048 B2
(45) Date of Patent: Sep. 9, 2008

(54) TRANSPORTABLE SAFETY BARRIER

(75) Inventor: Jesper Andersen, Lasby (DK)

(73) Assignee: Baby Dan A/S, Lasby (DK)

( * ) Notice: Subject to any disclaimer, the term of this patent is extended or adjusted under 35 U.S.C. 154(b) by 159 days.

(21) Appl. No.: 10/547,422

(22) PCT Filed: Feb. 16, 2004

(86) PCT No.: PCT/DK2004/000104

§ 371 (c)(1),
(2), (4) Date: Sep. 6, 2005

(87) PCT Pub. No.: WO2004/079142

PCT Pub. Date: Sep. 16, 2004

(65) Prior Publication Data

US 2006/0180283 A1 Aug. 17, 2006

Related U.S. Application Data

(60) Provisional application No. 60/455,554, filed on Mar. 19, 2003.

(30) Foreign Application Priority Data

Mar. 5, 2003 (DK) ..... PA 2003 00342

(51) Int. Cl.
*E06B 9/02* (2006.01)

(52) U.S. Cl. ..... 160/377; 49/55; 49/465

(58) Field of Classification Search ..... 160/351, 160/377, 372, 371, 222, 215; 49/55, 57, 49/463, 465

See application file for complete search history.

(56) References Cited

U.S. PATENT DOCUMENTS 3,801,208 A 4/1974 Bourgraf et al.

(Continued)

FOREIGN PATENT DOCUMENTS

DE 19742636 4/1999

OTHER PUBLICATIONS

"Child Care Articles-Safety Barriers-Safety Requirements and Test Methods", in British Standard No. BS En 1930-2000.

*Primary Examiner*—David Purol
(74) *Attorney, Agent, or Firm*—Dykema Gossett pLLC

(57) ABSTRACT

A foldable safety barrier to be secured in and removed from a door opening, comprising a frame having a covering member (28), such as a piece of fabric, said frame being formed by upper and lower cross members (1, 2) connected with first and second lateral posts (3, 4) by means of four angle brackets (5, 6, 7, 8), each of which has first and second legs, and constructed such that the upper (1) and lower (2) cross members consist of two pipes (9, 10) which are mutually displaceable, while the first and second lateral posts (3, 4) consist of two pipes (13, 14) which are interconnected by means of lockable hinge links (15, 19). The outer dimensions of the hinge links (15, 19) correspond to the outer dimensions of the lateral posts (3, 4). Two of the four angle brackets (5, 6, 7, 8) have arranged therein a threaded rod (29) having a ferrule (30) and optional pressure indicators, while a spring-biased threaded rod (24) having a ferrule (25) is arranged in the third angle bracket, and a housing (21) having a block movable in the housing (21) is arranged in the fourth angle bracket. The invention provides a foldable safety barrier having incorporated safety means, it being ensured that children cannot climb over the barrier as there are no faces on which the child can support its foot. Further, it can always be checked whether the barrier is fixed in a frame with a sufficient force.

4 Claims, 4 Drawing Sheets

U.S. PATENT DOCUMENTS 4,063,830 A 12/1977 Ban
5,217,315 A 6/1993 Rosane
5,483,779 A * 1/1996 Crawford et al. ..... 52/645
5,531,258 A 7/1996 Poulson et al.
5,638,885 A 6/1997 Freese et al.
5,704,164 A 1/1998 Huang
5,941,011 A 8/1999 Baker
6,127,019 A * 10/2000 Means ..... 428/120
2001/0015266 A1 * 8/2001 Yates et al. ..... 160/84.06
2002/0157316 A1 * 10/2002 Andersen ..... 49/55

* cited by examiner

TRANSPORTABLE SAFETY BARRIER

BACKGROUND OF THE INVENTION

1. Field of The Invention

The invention relates to a foldable safety barrier to be secured in an opening, such as a door opening, a staircase or a window, and comprising a frame having an upper cross member and a lower cross member as well as first and second lateral posts, said upper and lower cross members as well said lateral posts being adapted to secure a covering which is defined by the upper and lower cross members as well as by the lateral posts, said upper and lower cross members consisting of two parts which are mutually displaceable so that the length of the upper and lower cross members may be adjusted, said lateral posts being provided with a hinge link to fold the lateral posts into the plane of the safety barrier.

2. The Prior Art

Such safety barriers are used e.g. in connection with journeys where they may be installed in a holiday flat, a hotel room, a summer cottage, etc.

Usually, the safety barriers are based on separate pipes, typically four, which are assembled to a frame, and which, prior to assembly, are passed through casings in a square piece of fabric which, after assembly, is partly fixed round the assembled pipe frame.

This frame is raised to a vertical position, and a bolt is typically mounted at the four ends, two in each of the horizontal pipes, said bolt having a rubber-coated head mounted therein which is fixed in an opening or a door frame. This fixing subjects the frame to pressure, and when fixed sufficiently the frame is safe enough to deny children up to a certain age access to or to prevent them from falling down stairs.

The drawback of these structures is that they are very cumbersome to assemble, and their size makes it almost impossible to carry them along on journeys e.g. in trunks because of the length of the pipes.

Further, it may be difficult to comply with safety standards since, typically, it cannot be controlled whether the safety barrier is fixed sufficiently.

DE 19742636 discloses a foldable frame for door safety purposes, where the frame is composed of upper and lower cross members as well as two lateral posts. Folding takes place in that two hinge brackets are mounted in the lateral posts to allow the lateral posts to be folded inwards toward each other so that the frame occupies less space during transport. A similar frame is known from U.S. Pat. No. 5,704,164.

It is common to the two known frames that the outer dimensions of the hinge brackets are different from those of the lateral posts, which means that in a folded-out state the frame has shoulders which a child may use when attempting to climb over the safety barrier.

Accordingly, the object of the invention is to provide a safety barrier which is safer than the known ones.

SUMMARY OF THE INVENTION

The object of the invention is achieved by a safety barrier which is characterized in that the outer dimensions of the hinge links correspond to the outer dimensions of the lateral posts. Hereby, the hinge links cannot be used as a support if a child tries to climb over the safety barrier.

When the lateral posts are coupled to the hinge link by means of their separate shafts, the hinge parts of the safety barrier are easier to manufacture with outer dimensions corresponding to those of the lateral posts.

Owing to the safety of the barrier, it is an advantage if the hinge links are provided with a lock which is adapted to lock the lateral posts in a non-folded state and to release the lock when the barrier is to be folded together.

A particularly advantageous way of making the hinge links in order to improve the safety additionally is that the lock comprises two push-buttons which are spring-loaded, and that the push-buttons are adapted to affect plate parts which, from a position in which they are locked against forwardly projecting parts, are moved into channels which allow the pipes to be rotated about the shafts.

The strength of safety barrier itself may be increased if the upper and lower cross members are coupled to the lateral posts with four angle brackets, each angle bracket having first and second bracket parts, said first bracket part being coupled to the lateral posts, said second bracket part being coupled to the upper and lower cross members, and that fixing parts facing toward the opening are coupled to the free end of the second bracket part.

The fixing parts are expediently configured in that the fixing parts at one end of the upper cross member are formed by a threaded rod carrying a ferrule at its free end, and at the other end by a threaded rod having a ferrule which is additionally coupled to a clamping device. This allows easy adjustment of the safety barrier.

To ensure that the safety barrier is sufficiently fixed in an opening, it is an advantage if a pressure indicator is additionally coupled to at least one of the bracket parts.

This pressure indicator is preferably provided in that it is formed by a sleeve having a thick part provided at one end which is affected by a spring element disposed in a housing, which is arranged in the bracket and consists of first and second sub-housings, and such that one end of the spring element engages the thick part of the sleeve and the other end thereof engages a shoulder in the first sub-housing, said sleeve having gripper hooks at its free end which engage the opposite side of the same shoulder in the second sub-housing, said shoulder defining the first and second sub-housings.

To fix the lower cross member effectively, it is expedient that the fixing parts at one end of the lower cross member are formed by a threaded rod having ferrules and at its other end by a housing having a block, said block being adapted to be moved axially out of the housing during angular displacement.

The invention will now be explained more fully with reference to the drawings.

BRIEF DESCRIPTION OF THE DRAWINGS

FIG. 3 shows the safety barrier of FIG. 2 in a folded-together state, while

DETAILED DESCRIPTION OF THE PREFERRED EMBODIMENT

Figure 1:
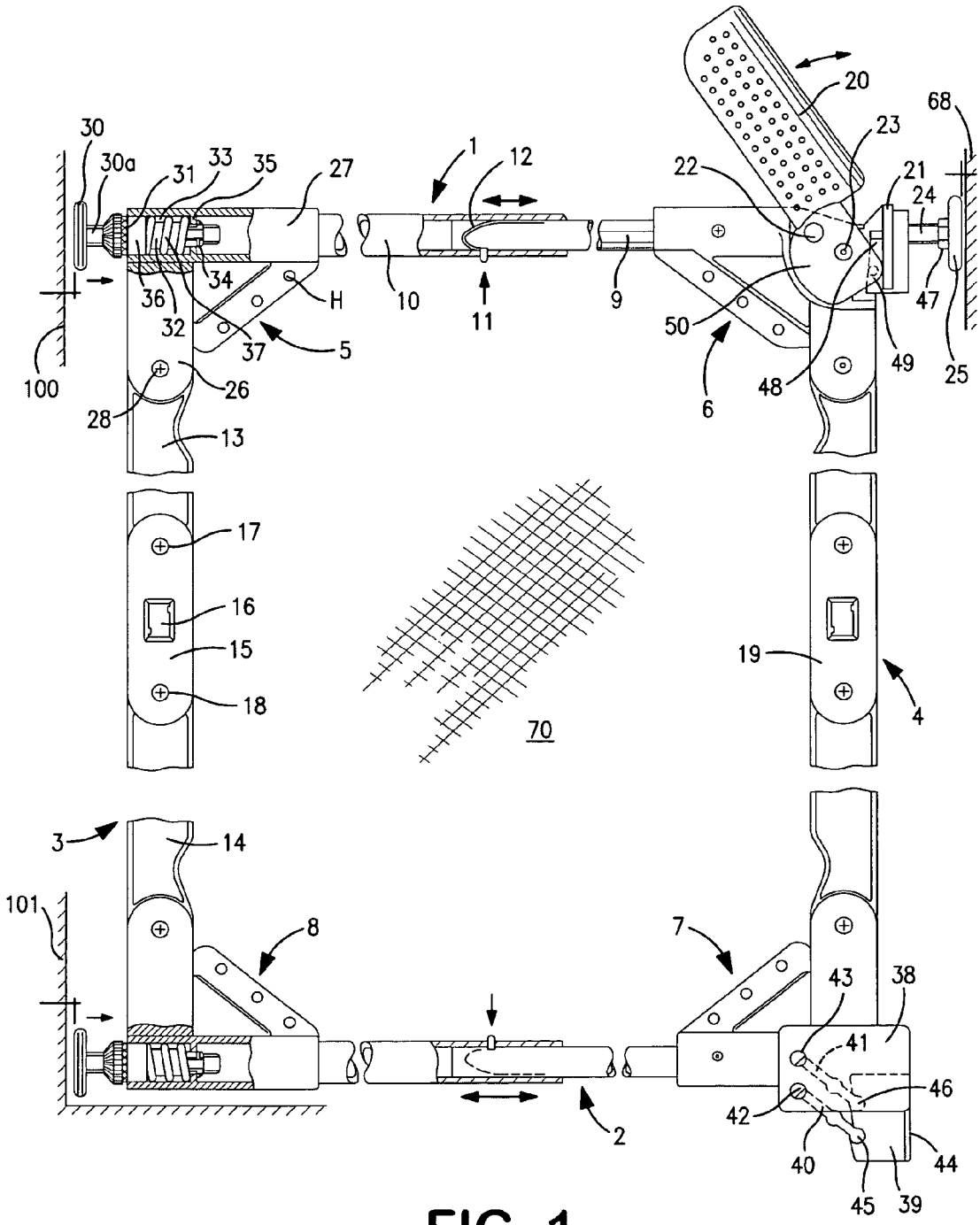
FIG. 1 shows a foldable safety barrier according to the invention in a folded-out state, seen from the front and before it is fixed in an opening.

FIG. 1 shows a foldable safety barrier according to the invention with parts of the safety barrier shown in section. The safety barrier consists of an upper cross member 1 and a lower cross member 2 as well as two lateral posts designated 3 and 4, respectively. The upper cross member 1 is connected with one end of the two lateral posts with the shown brackets 5 and 6, while the lower cross member is connected with the other end of the lateral posts with the shown brackets 7 and 8.

The upper and lower cross members are configured identically, and, as will be seen, they consist of two pipes designated 9 and 10 which may be inserted into each other and be secured in given positions, where one pipe in the figure, the shown pipe 9, is formed with a plurality of holes in which a button 11 with a spring load 12, positioned at one end of the pipe 10, may engage and lock the pipes 9, 10 in given positions. Suitable selection of a hole, in which the button 11 is to lock the pipes 9, 10 to each other, allows the width of the safety barrier to be adapted to a given opening, as will be explained more fully later.

As will additionally be seen, the two lateral posts 3, 4 are configured identically and consist of two pipes 13, 14 interconnected via hinge links 15, 19, said pipes being connected with the hinge parts by means of shafts 17, 18 which extend through the hinge link and which may be constructed as threaded rods, bolts and other similar shafts constructed in a known manner.

As will additionally be seen in the figure, the hinge link has a push-button 16 which, as will be explained later, is adapted to lock the two pipes 13, 14 connected with the hinge link, when the safety barrier is in a folded-out state, and to release the lock when the safety barrier is to be folded together.

It is noted that the outer dimensions of the hinge links 15, 19 correspond closely to the outer dimensions of the pipes 13, 14.

The brackets 5-8 are essentially identical and have two legs 26 and 27, as will be seen at the bracket 5. The leg 26 is connected with the pipe 13 on the lateral post 3 by means of a shaft which extends through the pipe 13 and the leg 26, and which may be configured as a threaded rod, bolt or the like. In the other leg 27, the one pipe 10 of the upper cross member is inserted into the leg 27. As will additionally be seen, the two legs 26 and 27 are interconnected by means of a plate member, in which holes are drilled, one of these being designated H. These holes are intended to secure a covering member (not shown) in the area which is defined by the upper and lower cross members 1, 2 as well as by the lateral posts 3, 4, said covering being designated 70.

The figures show four brackets, of which a first bracket 6 is formed with adjustment and clamping means, while a second one 7 is just formed with clamping means. The two last ones are formed with adjustment means and optionally a pressure indicator. The adjustment means are identical in the four brackets and consist of a threaded rod 29 which is terminated by a ferrule 30 at one end. The threaded rod cooperates either with threads provided in the bracket or with threads provided in a sleeve 32, which, as will be explained below, is intended to constitute a pressure indicator. The sleeve 32 forms part of a pressure indicator and is therefore preferably coloured, e.g. red, cf. the following.

Further, the threaded rod 29 has screwed on to it a nut 31 which is intended to lock the threaded rod in a given position, as the nut may be tightened against the sleeve 32 which is formed with a thicker part 36. As will be seen, the sleeve is movable in a housing which consists of two sub-housings designated 33 and 34. The two sub-housings are separated by a shoulder 35. The sleeve 32 is formed with a plurality of spring elements 37 which hold the sleeve in the housing 33, 34, when the spring elements are pressed into the second sub-housing.

Inside the sub-housing 33, in which the spring element 37 is positioned, it engages the shoulder 35 at its one end and the thicker part 36 of the sleeve 32 at its other end. Hereby, when the spring element 37 is not subjected to impacts, the sleeve will be locked by the spring elements which engage the shoulder. If the ferrule is subjected to pressure, the spring element will be pressed together, and the sleeve 32 will then be moved in the sub-housings 33 and 34. As will be explained later, the threaded rod, ferrule and sleeve will act as adjustment means which are equipped with a pressure indicator.

The bracket 7, which is provided with clamping means, is composed of a block 39 having an engagement face 44 which is movable in a housing 38. The movement is provided by two parallel rods 40, 41 which, at their ends, have the shown pivots 42, 43 in the housing 38 and 45, 46 on the block 39. The block operates such that when affected by a vertical force it will rotate about the axes of rotation and be displaced in a horizontal plane out of the housing, so that the distance from the engagement face to the pivots 42, 43 is maximum.

The bracket 6, which is also formed with clamping means, cooperates with the same type of adjustment means as are explained in connection with the brackets 5 and 8, but without a pressure indicator, i.e. consists solely of a threaded rod 24 with a ferrule 25 and a lock nut 47. On the threaded rod behind the lock nut there is arranged a movable housing 21 having inner threads which cooperate with the threaded rod 24. The housing 21 accommodates a groove 48 in which a pin 49 provided on a part 50 of a handle 20 may slide. As will be seen, the part 50 on the handle 20 is in contact with the housing 21. The handle 20 may be moved about an axis of rotation 23. Inside the bracket, the threaded rod is connected with a spring (not shown) which pulls the threaded rod 24 and the housing 21. When the handle 20 is pressed downwards, the part 50 will displace the housing 21 and the threaded rod 24 with ferrule to the right in the figure. When the handle is horizontal, it will be locked and can be activated only after activation of a push-button 22 on the part 50 which releases a locking mechanism (not shown).

The structure of the hinge links 15 and 19 will now be explained in connection with FIGS. 4*a*-4*e*.

Figures 4A, 4B, 4C, 4D, 4E:
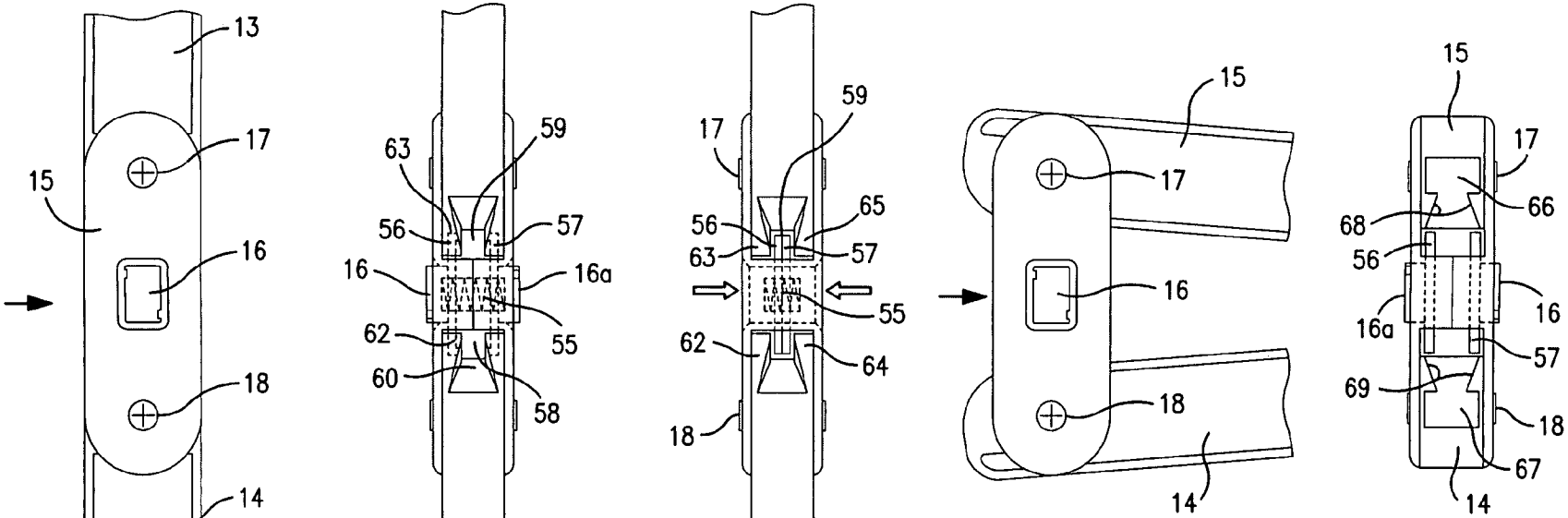
FIGS. 4*a*-4*e* show a hinge used in the safety barrier of FIGS. 1-3 in different working positions.

FIG. 4*a* shows the hinge link 15 which connects the pipes 13 and 14 in FIG. 1. The hinge link has two shafts of rotation designated 17 and 18 in the figures. The hinge link may be locked and opened by means of a spring-loaded push-button, as will be explained below.

A spring is arranged centrally in the hinge link and applies a force to push-buttons 16 and 16*a* at its free ends. The side of the push-buttons facing into the hinge link 15 engages plate parts 62, 63, which are provided with holes for the passage of the spring 55 to the push-buttons 16 and 16*a*.

In the position shown in FIG. 4*b*, the hinge link is locked, as the plates with their one outer arm engage forwardly projecting parts, designated 62-65, cf. also FIG. 4*c*, provided in the pipes 13 and 14.

As will additionally be seen, channels 58, 59 are provided between the forwardly projecting parts 62, 64 and 63, 65, respectively.

FIG. 4*e* shows further details of the hinge in the direction of the arrow in FIG. 4*d*. The shoulders 63 and 64 are formed with inclined flanks 68, 69 on which the plates 56, 57 may slide, when the legs 14, 15 are moved from the position shown in FIG. 4*d* to the position shown in the other figures.

When the legs have been straightened completely, the plates will leave the flanks 68, 69 and click into and rest in the shown cavities 66, 67. When the safety barrier is to be folded together again, the push-buttons 53, 54 are merely activated, and then the plates 56, 57 may again be moved to the position shown in FIG. 4*e* through the narrowed section between the cavities 66, 67 and the flanks 68, 69.

Figure 3:
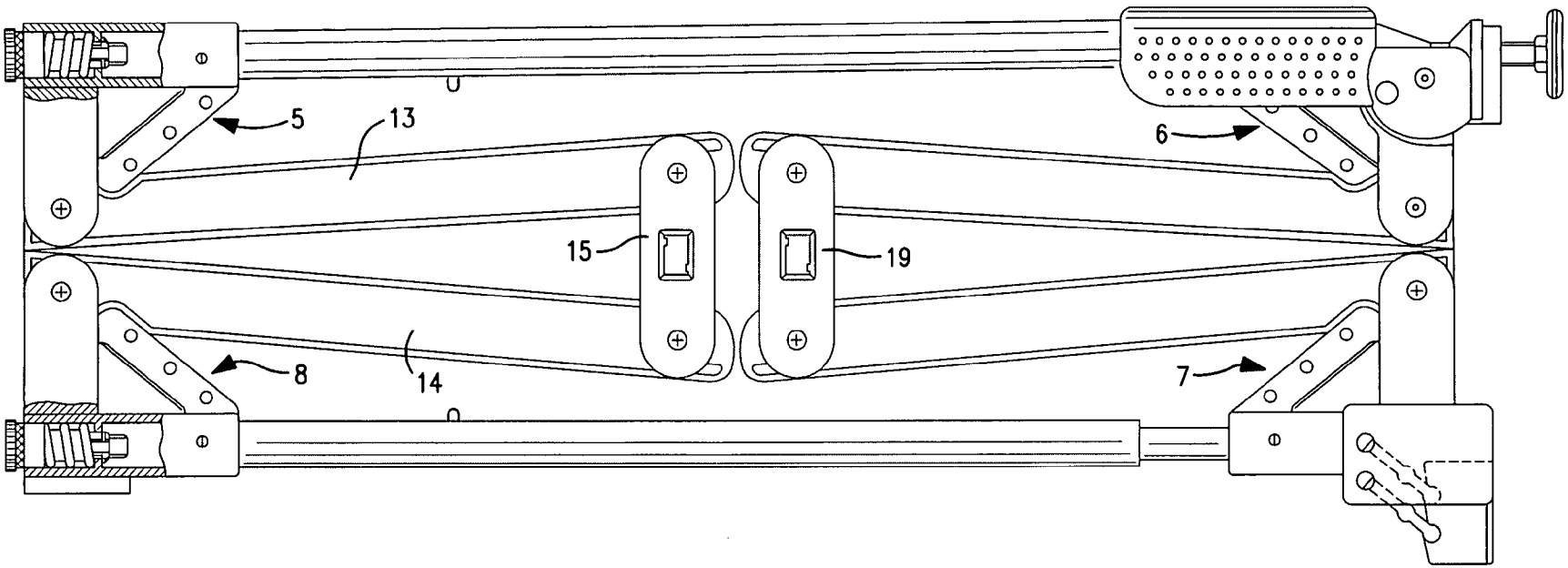

It will now be explained how the safety barrier according to the invention is used, it being assumed that the safety barrier is constructed as shown, in the folded-together state shown in FIG. 3.

Figure 2:
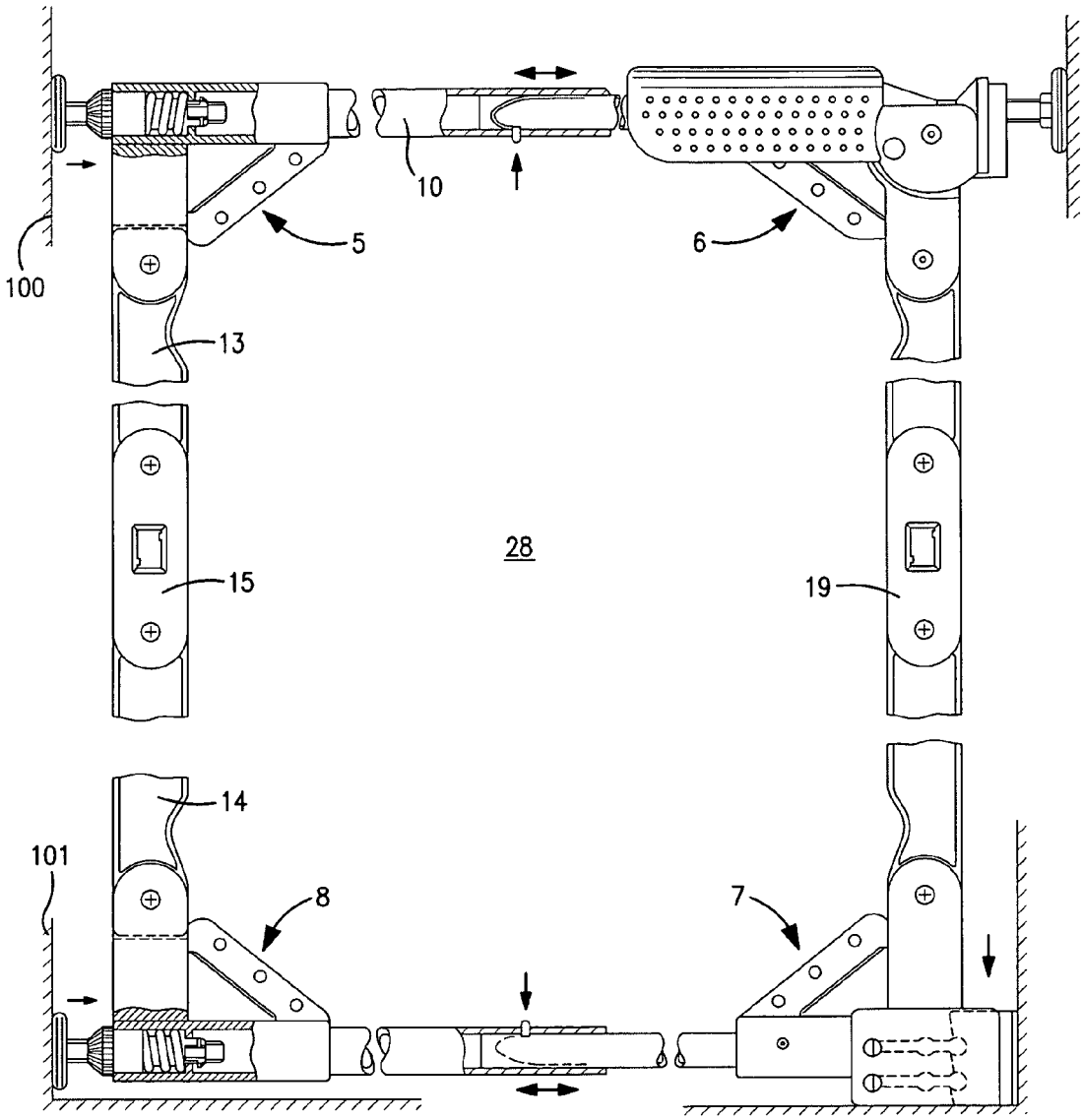
FIG. 2 shows the safety barrier of FIG. 1, but now fixed in an opening.

The push-buttons 53, 54 on the two hinge links are activated, following which the safety barrier is unlocked and folded out to the position shown in FIG. 1. The lower cross member of the safety barrier is placed against the lower frame whose upper and lower sides are designated 66, 67 in FIG. 1, while the upper part of the other side is designated 68, whereas the lower part of the other side is just shown in FIG. 2. The push-buttons 11 are activated, and the pipes 9, 10 are extended as much as possible, corresponding to the opening defined by the frame, following which the two threaded rods 24, 29 with ferrules 25, 30 are adjusted to a distance which is about 3 mm from the frame. The block, too, is placed close to the frame so as be about 3 mm from the frame. The safety barrier is now raised in the frame, and vertical pressure from above causes the lower part of the safety barrier to be fixed in the frame.

Then the handle 20 is activated, thereby causing fixing against the upper part of the frame. It is now checked that the sleeves 36 cannot be seen. If it turns out that they can be seen, the fixing is not great enough to comply with current regulations, and the safety barrier must be loosened from the frame, and threaded rods with ferrules must be screwed slightly further out, following which the fixing is again performed as explained above, and then the sleeve should be concealed in the brackets.

The invention claimed is:

1. A foldable safety barrier to be secured in an opening, such as a door opening, a staircase or a window, and comprising a frame having an upper cross member and a lower cross member as well as first and second lateral posts, said upper and lower cross members as well as said first and second lateral posts being adapted to secure a covering which is defined by the upper and lower cross members as well as by the lateral posts, said upper and lower cross members consisting of two parts which are mutually displaceable so that a length of the upper and lower cross members may be adjusted, said lateral posts being provided with a hinge link to fold the lateral posts into a plane of the safety barrier, wherein outer dimensions of the hinge link and the first and second lateral posts are the same in a direction parallel to the upper and lower cross members when the safety barrier is in a folded-out state, and outer dimensions of the hinge link and the first and second lateral posts correspond closely in the direction parallel to the shafts of the hinge link, and the hinge links include a lock which comprises two push-buttons which are spring-loaded, said lock locking the lateral posts in a non-folded state and releasing the lateral posts when the safety barrier is to be folded together, the upper and lower cross members being coupled to the lateral posts with four angle brackets, each angle bracket having first and second bracket parts, said first bracket part being coupled to the lateral posts, said second bracket part being coupled to the upper and lower cross members, wherein fixing parts facing toward an opening are coupled to a free end of the second bracket part, wherein the fixing parts at one end of the upper cross member are formed by a threaded rod carrying a ferrule at a free end thereof, and at the other end by a threaded rod having a ferrule which is additionally coupled to a clamping device, wherein a pressure indicator is coupled to at least one of the bracket parts, the pressure indicator being formed by a sleeve having a thick part provided at one end which is affected by a spring disposed in a housing, which is arranged in the bracket and which consists of first and second sub-housings, and such that a first end of the spring engages the thick part of the sleeve and a second end thereof engages a shoulder in the first sub-housing, said sleeve having gripper hooks at a free end thereof which engage an opposite side of the same shoulder in the second sub-housing, said shoulder serving to define the first and second sub-housings.

2. A safety barrier according to claim 1, wherein each of said first and second lateral posts includes two pipes interconnected by a hinge link.

3. A safety barrier according to claim 2, wherein each of said pipes includes two forwardly-projecting parts which extend into a respective hinge link and which define a channel therebetween, and wherein each said hinge link includes plates which can be respectively moved by said two push buttons into a channel to release the pipes of a perspective lateral post.

4. A safety barrier according to claim 1, wherein the fixing parts at one end of the lower cross member are formed by a threaded rod having a ferrule and at its other end by a housing having a block, said block being adapted to be moved axially out of the housing during angular displacement.

* * * * *